US012031347B2

(12) United States Patent
Scherbauer

(10) Patent No.: US 12,031,347 B2
(45) Date of Patent: Jul. 9, 2024

(54) SUBTERRANEAN HOTEL

(71) Applicant: Frederick William Scherbauer, Centerville, OH (US)

(72) Inventor: Frederick William Scherbauer, Centerville, OH (US)

( * ) Notice: Subject to any disclaimer, the term of this patent is extended or adjusted under 35 U.S.C. 154(b) by 301 days.

(21) Appl. No.: 17/690,375

(22) Filed: Mar. 9, 2022

(65) Prior Publication Data

US 2022/0290454 A1 Sep. 15, 2022

Related U.S. Application Data

(60) Provisional application No. 63/158,403, filed on Mar. 9, 2021.

(51) Int. Cl.

| | |
|---|---|
| ***E04H 3/02*** | (2006.01) |
| ***E04B 7/18*** | (2006.01) |
| ***E04F 17/06*** | (2006.01) |
| ***E04H 6/08*** | (2006.01) |

(52) U.S. Cl.

CPC ..... *E04H 3/02* (2013.01); *E04B 7/18* (2013.01); *E04F 17/06* (2013.01); *E04H 6/08* (2013.01)

(58) Field of Classification Search

CPC .... E04H 3/02; E04H 6/08; E04H 1/04; E04H 1/02; E04B 7/18; E04F 17/06

See application file for complete search history.

(56) References Cited

U.S. PATENT DOCUMENTS

| | | | | | |
|---|---|---|---|---|---|
| 2,241,830 | A * | 5/1941 | Tourtellotte | E04H 1/04 | 52/169.4 |
| 4,078,346 | A * | 3/1978 | Mann | E04H 9/06 | 52/169.4 |
| 4,336,674 | A * | 6/1982 | Weber | E04H 9/12 | 52/630 |
| 4,352,260 | A * | 10/1982 | Pearcey | E04B 1/3211 | D25/19 |
| 4,429,501 | A * | 2/1984 | de Brabant | E04H 1/04 | D25/31 |
| 4,642,952 | A * | 2/1987 | Prandin | E04H 9/12 | 109/1 S |
| 4,761,716 | A * | 8/1988 | Mori | F21S 11/00 | 362/147 |

(Continued)

FOREIGN PATENT DOCUMENTS

| | | | |
|---|---|---|---|
| CN | 106939725 | A | 7/2017 |
| KR | 20060033460 | A | 4/2006 |

(Continued)

*Primary Examiner* — Paola Agudelo

(74) *Attorney, Agent, or Firm* — Wood Herron & Evans LLP

(57) ABSTRACT

A subterranean hotel is provided which includes, in one embodiment, a first row of subterranean atrium hotel rooms, a second row of subterranean atrium hotel rooms, a first row of patio hotel rooms, and a second row of patio hotel rooms. The atrium hotel rooms and the patio hotel rooms may be located at least in part below the ground surface (i.e., below a grade) on at least one subterranean floor level. The subterranean hotel may include an intermediate atrium that abuts with the atrium hotel rooms such that the first row of the atrium hotel rooms may be spaced from the second row of the atrium hotel rooms by the intermediate atrium.

14 Claims, 7 Drawing Sheets

(56) References Cited

U.S. PATENT DOCUMENTS

| | | | | |
|---|---|---|---|---|
| 4,837,989 | A * | 6/1989 | Levy | E04H 14/00 52/27 |
| 5,467,564 | A | 11/1995 | DeKeyser et al. | |
| 5,603,189 | A * | 2/1997 | Levy | E04H 1/04 119/245 |
| 5,703,720 | A | 12/1997 | Fulco et al. | |
| 5,775,043 | A * | 7/1998 | Muroi | F24F 7/04 414/244 |
| 5,809,704 | A * | 9/1998 | Stewart | E04H 1/04 52/169.4 |
| 6,182,408 | B1 * | 2/2001 | Poehler | E04H 1/02 52/234 |
| 9,013,788 | B2 | 4/2015 | Whitehead | |
| 2004/0074173 | A1 * | 4/2004 | Miller | G06Q 10/06 52/234 |
| 2005/0252102 | A1 * | 11/2005 | Buchi | E04F 17/06 52/107 |
| 2017/0081863 | A1 * | 3/2017 | Bramble | F21S 11/007 |
| 2018/0230692 | A1 * | 8/2018 | Thebaud | E04B 1/34861 |

FOREIGN PATENT DOCUMENTS

| | | | |
|---|---|---|---|
| KR | 101093453 | B1 | 12/2011 |
| KR | 20140139161 | A | 12/2014 |

* cited by examiner

SUBTERRANEAN HOTEL

CROSS-REFERENCE TO RELATED APPLICATION

The present application claims the filing benefit of U.S. Provisional Application Ser. No. 63/158,403, filed Mar. 9, 2021, the disclosure of which is incorporated herein by reference in its entirety.

FIELD OF THE INVENTION

The present invention relates generally to building structures and, more particularly, to a configuration of a hotel having guest rooms that are subterranean.

BACKGROUND OF THE INVENTION

Traditionally, hotels are primarily built above ground level. This is due in part because of two limitations. First, building code requirements dictate natural light be made available to every guest room in a hotel. Second, hotel-goers prefer, and are accustomed to, staying in an above-ground room with natural light.

Consequentially, with an above-ground layout, current hotels may incur several drawbacks. For example, hotels typically must utilize sizeable portions of land to accommodate guest rooms and amenities. Further, being above-ground exposes a hotel to inclement weather conditions. This may result in large operating expenses for the hotel due to HVAC operation attempting to offset the fluctuations in the surrounding environment, and necessary expense in designing a structure that attempts to mitigate ambient noise.

Considering the aforementioned limitations and drawbacks, a need still exists for an improved hotel structure that addresses the problems stemming from land size, environmental concerns, and operational costs encountered by typical hotels.

SUMMARY OF THE INVENTION

The present invention overcomes the foregoing and other shortcomings and drawbacks of hotels heretofore known. While the invention will be described in connection with certain embodiments, it will be understood that the invention is not limited to these embodiments. On the contrary, the invention includes all alternatives, modifications and equivalents as may be included within the spirit and scope of the present invention.

The present invention, according to one embodiment, is directed to the subterranean hotel which may include a first row of subterranean atrium hotel rooms located on a first subterranean floor level, a second row of subterranean atrium hotel rooms located on the first subterranean floor level which is spaced from the first row of atrium hotel rooms by an intermediate atrium which has at least one atrium window configured to allow natural light to pass through the at least one atrium window from outside the subterranean hotel to an interior of the intermediate atrium.

According to one embodiment, each of the first and second rows of atrium hotel rooms has a respective floor, an opposite ceiling and a plurality of sidewalls that extend between the floor and the ceiling. One of the plurality of sidewalls located adjacent the intermediate atrium includes at least one atrium window that is configured to allow natural light to pass through the at least one atrium window from the intermediate atrium to an interior of the hotel room.

The subterranean hotel according to one embodiment may include a first row of subterranean patio hotel rooms located on the first floor level that is spaced from the first row of subterranean atrium hotel rooms in a direction away from the intermediate atrium by a first elongated hallway. Each of the first row of patio hotel rooms has a respective floor, an opposite ceiling and a plurality of sidewalls extending between the floor and the ceiling. One of the plurality of sidewalls located adjacent a first outside window well includes at least one first patio window that is configured to allow nature light to pass through the at least one first patio window from the first outside window well to an interior of the patio hotel room.

In one embodiment, the subterranean hotel includes a second row of subterranean patio hotel rooms located on the first floor level that is spaced from the second row of subterranean atrium hotel rooms in a direction away from the intermediate atrium by a second elongated hallway. Each of the second row of patio hotel rooms has a respective floor, an opposite ceiling and a plurality of sidewalls extending between the floor and the ceiling. One of the plurality of sidewalls located adjacent a second outside window well includes at least one second patio window that is configured to allow natural light to pass through the at least one second patio window from the second outside window well to an interior of the patio hotel room.

The atrium hotel rooms and the patio hotel rooms may be located at least in part below the ground surface (i.e., below grade) on at least one subterranean floor level.

In another embodiment, where more than one subterranean floor level exists. The atrium hotel rooms and the patio hotel rooms may be located throughout multiple subterranean floor levels.

In one embodiment, the subterranean hotel includes an elongated atrium floor that is located on the first floor level between the first row of atrium hotel rooms and the second row of atrium hotel rooms. The elongated atrium floor may include at least one opening extended therethrough that is configured to allow nature light to pass through the at least one opening from the atrium to the second floor level.

According to one embodiment, the subterranean hotel may also include at least one above-ground level which may comprise a parking structure.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION OF THE INVENTION

In the preceding and following sections, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "at least" followed by a number is used herein to denote the start of a range beginning with that number (which may be a range having an upper limit or no upper limit, depending on the variable being defined). For example, "at least 1" means 1 or more than 1.

These embodiments are described in sufficient detail to enable those skilled in the art to practice the invention, and it is understood that other embodiments may be utilized, and that logical structural or mechanical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1:
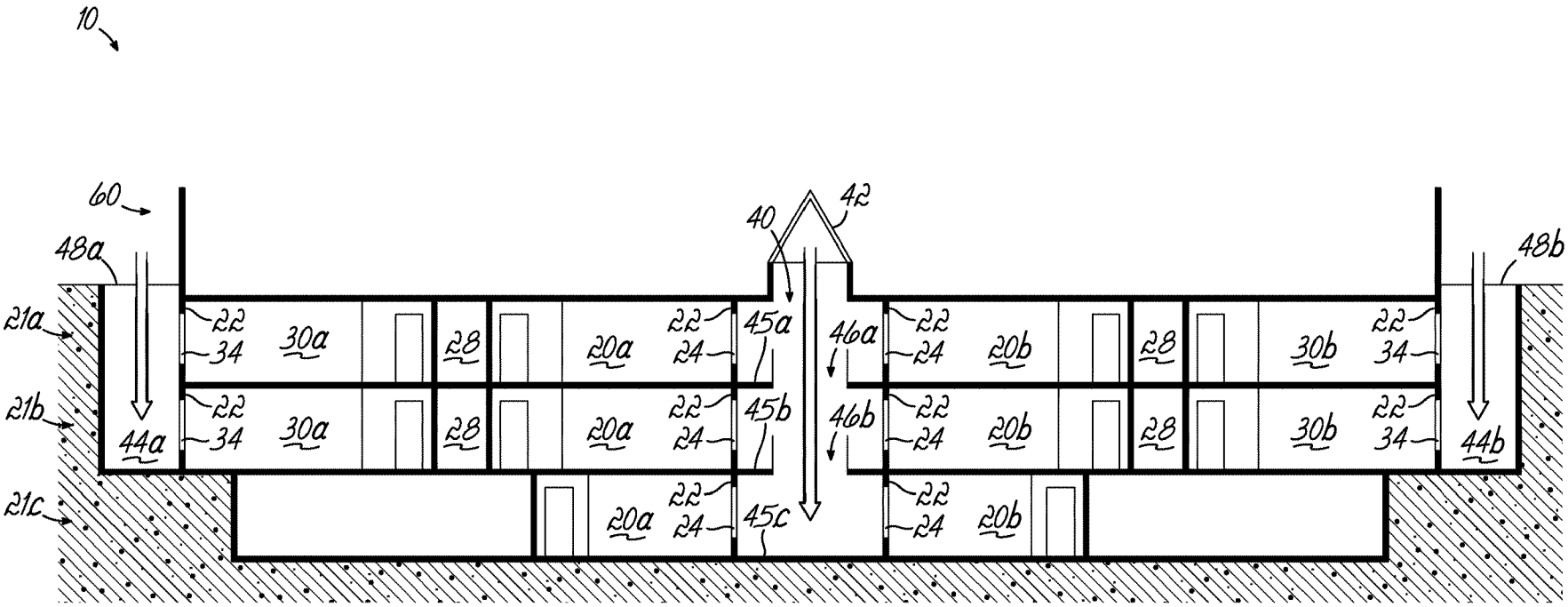
FIG. 1 is a front elevation view of a subterranean hotel in accordance with one embodiment of the present invention.
Figure 2:
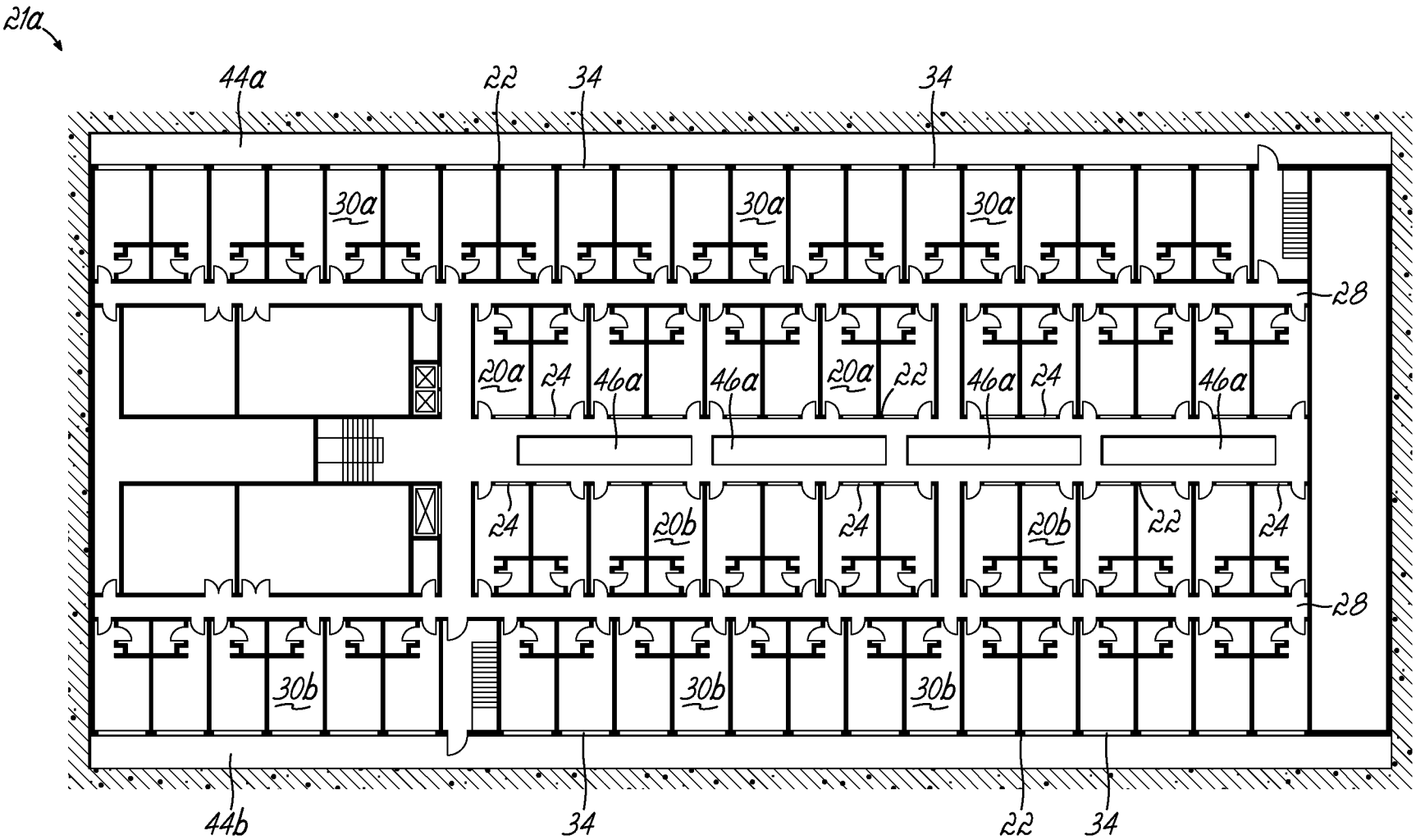
FIG. 2 is a top plan view of an exemplary first subterranean floor level of the subterranean hotel of FIG. 1.

With reference to FIGS. 1 and 2, an exemplary subterranean hotel 10 according to one embodiment of the present invention is illustrated. The subterranean hotel 10 may include a first row of subterranean atrium hotel rooms 20*a*, a second row of subterranean atrium hotel rooms 20*b*, a first row of patio hotel rooms 30*a*, and a second row of patio hotel rooms 30*b*, all of which are respectively positioned according to one embodiment in one or more generally longitudinal rows as shown in FIG. 2. The atrium hotel rooms 20*a*, 20*b* and the patio hotel rooms 30*a*, 30*b* may be located at least in part below the ground surface (i.e., below grade) on at least one subterranean floor level 21. For example, in an embodiment where only a single subterranean floor level 21 exists, both the atrium hotel rooms 20*a*, 20*b* and the patio hotel rooms 30*a*, 30*b* may be located on the subterranean floor level 21. In another embodiment, where more than one subterranean floor level 21 exists, the atrium hotel rooms 20*a*, 20*b* and the patio hotel rooms 30*a*, 30*b* may be located throughout multiple subterranean floor levels 21.

For example, FIG. 1 illustrates three subterranean floor levels (21*a*, 21*b*, 21*c*), with subterranean floor level 21*b* being located below subterranean floor level 21*a*, and subterranean floor level 21*c* being located below subterranean floor level 21*c*. Additionally, there may be a floor, such as subterranean floor level 21*c*, where only a subset of the atrium hotel rooms 20*a*, 20*b* and/or the patio hotel rooms 30*a*, 30*b* may be located. In other words, any combination of the atrium hotel rooms 20*a*, 20*b* and/or the patio hotel rooms 30*a*, 30*b* of the subterranean hotel 10 may be located on one or more subterranean floor levels 21. However, where both atrium hotel rooms 20 and patio hotel rooms 30 are located on the same subterranean floor level 21, the patio hotel rooms 30 may be spaced from the atrium hotel rooms 20 in a direction away from an intermediate atrium 40 (discussed below) by at least one elongated hallway 28.

Figure 1A:
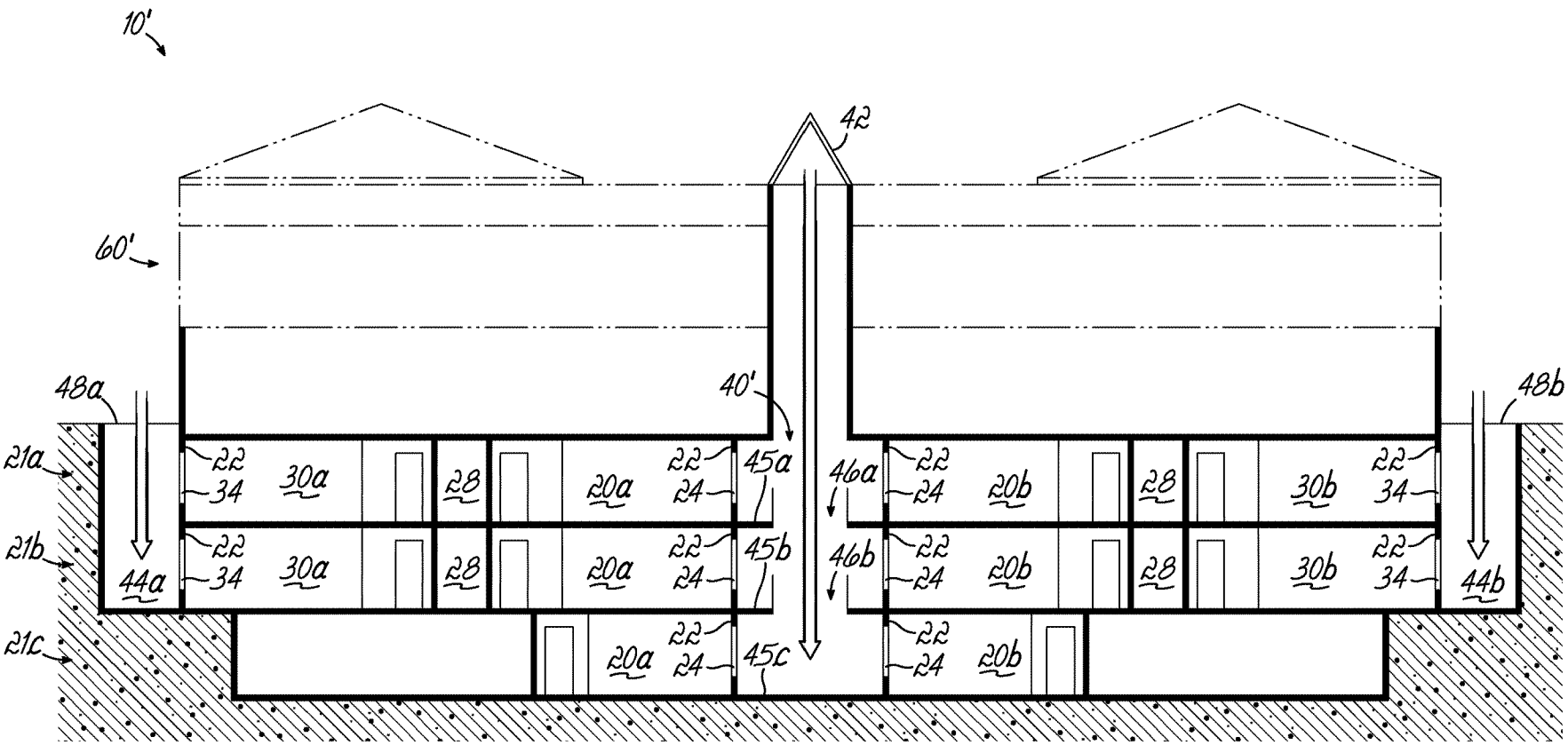
FIG. 1A is a front elevation view of an alternative subterranean hotel in accordance with another embodiment of the present invention.

The subterranean hotel 10 may feature an intermediate atrium 40 that abuts with the atrium hotel rooms 20*a*, 20*b*. In other words, the first row of the atrium hotel rooms 20*a* may be spaced from the second row of the atrium hotel rooms 20*b* by the intermediate atrium 40. The intermediate atrium 40 may have at least one atrium window 42 that is configured to allow natural light to pass through the at least one atrium window 42 from outside the subterranean hotel 10 to an interior of the intermediate atrium 40. In some embodiments, the atrium window 42 may not be a window, but rather any type of light-transmissive structure that enables light to propagate through it. The intermediate atrium 40 may also have an atrium floor 45 for each subterranean floor level 21. The atrium floor 45 may be of an elongated shape in order to span the atrium hotel rooms 20*a*, 20*b*. In embodiments where there is more than one subterranean floor level 21, such as in the embodiment illustrated in FIG. 1, at least one opening 46 may exist as part of the atrium floor 45 for at least one of the subterranean floor levels 21. For example, in the current embodiment with three subterranean floor levels 21*a*, 21*b*, 21*c*, there is an atrium floor 45*a*, 45*b*, 45*c* for each subterranean floor level 21, and the atrium floors 45*a*, 45*b* include an opening 46*a*, 46*b* respectively. The configuration of an opening 46 extended therethrough an atrium floor 45 allows natural light to pass through the opening 46 from the subterranean floor level 21 where the opening 46 is located to the subterranean floor level 21 located immediately below. In the embodiment of FIGS. 1 and 1A, the natural light of the intermediate atrium 40 is depicted as passing through the opening 46*a* into the subterranean floor level 21*b*, and subsequently through the opening 46*b* into the subterranean floor level 21*c*.

Referring now to FIGS. 1A and 2A—4, and with continuing reference to FIGS. 1 and 2, wherein like numerals represent like features, the present invention is described in further detail. As described above, the subterranean hotel 10 may include multiple levels. Importantly, at least one of the levels is a subterranean floor level 20, where at least one of the plurality of atrium hotel rooms 20 or at least one of the plurality of patio hotel rooms 30 is present. As used herein, the term "subterranean" as applied to a hotel guest level refers to the placement of a hotel guest level of a hotel such that a plane running horizontally along the hotel guest level at least partially intersects with an area below the surface (i.e., below grade) at the geographic location of the hotel. For example, as shown in FIG. 1 with subterranean floor levels 21*a*, 21*b*, and 21*c* in the present embodiment, all hotel guest levels may be entirely located underground. However, a hotel guest level may also be located partially underground (not shown), such as extending out from a hillside, and still be considered subterranean in the context of the present invention.

Alternatively, hotel guest levels may be present in an embodiment that comprise a combination of entirely underground hotel guest levels and partially underground hotel guest levels. By utilizing subterranean levels, the above surface footprint of a hotel can be minimized to occupy less land and inclement weather conditions will likely have a lesser effect on climate control operations of the subterranean hotel as compared to an above-ground hotel. With the insulative properties and normalized environment available by being subterranean, HVAC operating expenses of the subterranean hotel are reduced and ambient noise is mitigated.

In an embodiment of the present invention, the subterranean hotel 10 may include a single above-surface level that may be utilized for a variety of purposes. For example, in FIGS. 1 and 4, a parking structure 60 may be provided as a single above-surface level to be utilized for guest parking. Other embodiments may use the above-surface level for additional hotel rooms, guest amenities, commercial attractions, or combinations thereof. Further embodiments may include multiple above-surface levels, as can be seen with parking structures 60*a* and 60*b* of the subterranean hotel 10' in FIG. 1A. These above-surface levels may also be utilized for a variety of purposes (e.g., additional hotel rooms, multi-level parking garage, and guest amenities).

In the embodiment as shown in FIG. 1, the subterranean hotel 10 may be generally polyhedron in shape. Specifically, as shown from the top plan views of FIGS. 2, 3, and 4, the subterranean hotel 10 may be of a generally rectangular or a generally hexahedral shape. Importantly, the shape of the subterranean hotel 10 must be such that allows for the inclusion of an intermediate atrium 40 (discussed below) that interfaces with the atrium hotel rooms 20, as well as at least one outside window well 44 (discussed below) along any portion of the perimeter of the subterranean hotel 10 that interfaces with the patio hotel rooms 30. Therefore, other embodiments of the present invention may comprise a subterranean hotel 10 having another suitable shape (e.g., generally toroidal, generally spherical) so long as the intermediate atrium 40 and the at least one outside window well 44 are present. Accordingly, the subterranean hotel 10 is not intended to be limited to the generally rectangular or generally hexahedral shape of the exemplary embodiment illustrated in the figures. In other words, while the exemplary embodiments depict longitudinal rows of atrium hotel rooms 20 and patio hotel rooms 30, the present invention is not limited to longitudinal rows of hotel rooms, but rather may comprise other row shapes, such as curved or circular rows of hotel rooms.

Importantly, the subterranean hotel 10 is constructed in a manner that natural light is able to reach each of the atrium hotel rooms 20 and the patio hotel rooms 30. This is possible in this embodiment, in part, with the incorporation of the intermediate atrium 40 and the outside window wells 44*a*, 44*b*, both of which are described below. By enabling natural light to reach every room, building code requirements tied to natural lighting are satisfied, making a subterranean hotel feasible. Also, the availability of natural light in every room appeals to the preference and custom of guests.

Each of the atrium hotel rooms 20*a*, 20*b* may be designed as a conventional hotel room. In other words, the atrium hotel room 20 may have a respective floor, an opposite ceiling and a plurality of sidewalls extending between the floor and the ceiling. Additionally, the atrium hotel room 20 may feature one of the plurality of sidewalls (sidewall 22), that is positioned to abut with the intermediate atrium 40, to include at least one atrium-room window 24. The atrium room window 24 is configured to allow natural light to pass through the atrium room window 24 from the intermediate atrium 40 to an interior of the atrium hotel room 20. In some embodiments, the atrium room window 24 may not be a window, but rather any type of light transmissive structure that enables light to propagate through it. Further, in other embodiments of the present invention, the sidewall 22 and the atrium room window 24 may be one in the same, i.e., the atrium room window 24 may span part, or the entirety, of the sidewall 22.

Likewise, each of the patio hotel rooms 30*a*, 30*b* may be designed as a conventional hotel room. In other words, the patio hotel room 30 may have a respective floor, an opposite ceiling and a plurality of sidewalls extending between the floor and the ceiling. Additionally, the patio hotel room 30 may feature one of the plurality of sidewalls (sidewall 22), that is positioned to abut with at least one of the outside window well 44*a*, 44*b*, to include at least one patio window 34. The patio window 34 is configured to allow natural light to pass through the at least one patio window 34 from at least one of the outside window wells 44*a*, 44*b* to an interior of the patio hotel room 30. In some embodiments, the patio window 34 may not be a window, but rather any type of light-transmissive structure that enables light to propagate through it. Further, in other embodiments of the invention, the sidewall 22 and the patio window 34 may be one in the same, i.e., the patio window 34 may span almost all, or the entirety, of the sidewall 22.

In an embodiment of the present invention, both the atrium hotel rooms 20 and the patio hotel rooms 30 may be each be organized in part in a first longitudinal row and a second longitudinal row on a subterranean floor level 21, as shown in the subterranean floor level 21*a* of FIG. 2. The organization may be such, as in FIG. 2, that the first longitudinal rows and the second longitudinal rows cover a substantial portion of a subterranean floor level, here the subterranean floor level 21*a*. Yet in some embodiments, as illustrated in FIG. 2B with the alternative subterranean floor level 21*a*' of the subterranean hotel 10', the first longitudinal rows and the second longitudinal rows may cover a less substantial portion of the subterranean floor level 21*a*'. This alternative embodiment may leave additional space on the subterranean floor level 21*a*' for other amenities. Various other features of the subterranean floor level 21*a*' are generally similar to those described throughout with respect to subterranean floor level 21*a* and are not repeated here for the sake of brevity.

In other embodiments, the atrium hotel rooms 20 and the patio hotel rooms 30 may be organized in different configurations. For example, in an embodiment where the subterranean hotel 10 is of a generally toroidal shape, the atrium hotel rooms 20 and the patio hotel rooms 30 may be organized in generally circular rings (not shown) or generally curved sections (not shown).

Additionally, in some embodiments, the atrium hotel rooms 20 and the patio hotel rooms 30 may also span one or more subterranean floor levels 21. A subterranean floor level 21 may include more than one longitudinal row of the atrium hotel rooms 20 or more than one row of the patio hotel rooms 30. However, the configuration will always be one such that the sidewall 22 of each of the atrium hotel rooms 20 abuts with the intermediate atrium 40. Likewise, the sidewall 22 of each of the patio hotel rooms 30 will always abut with the at least one outside window well 44. This configuration provides for natural light to reach each of the atrium hotel rooms 20 and the patio hotel rooms 30.

Figure 3:
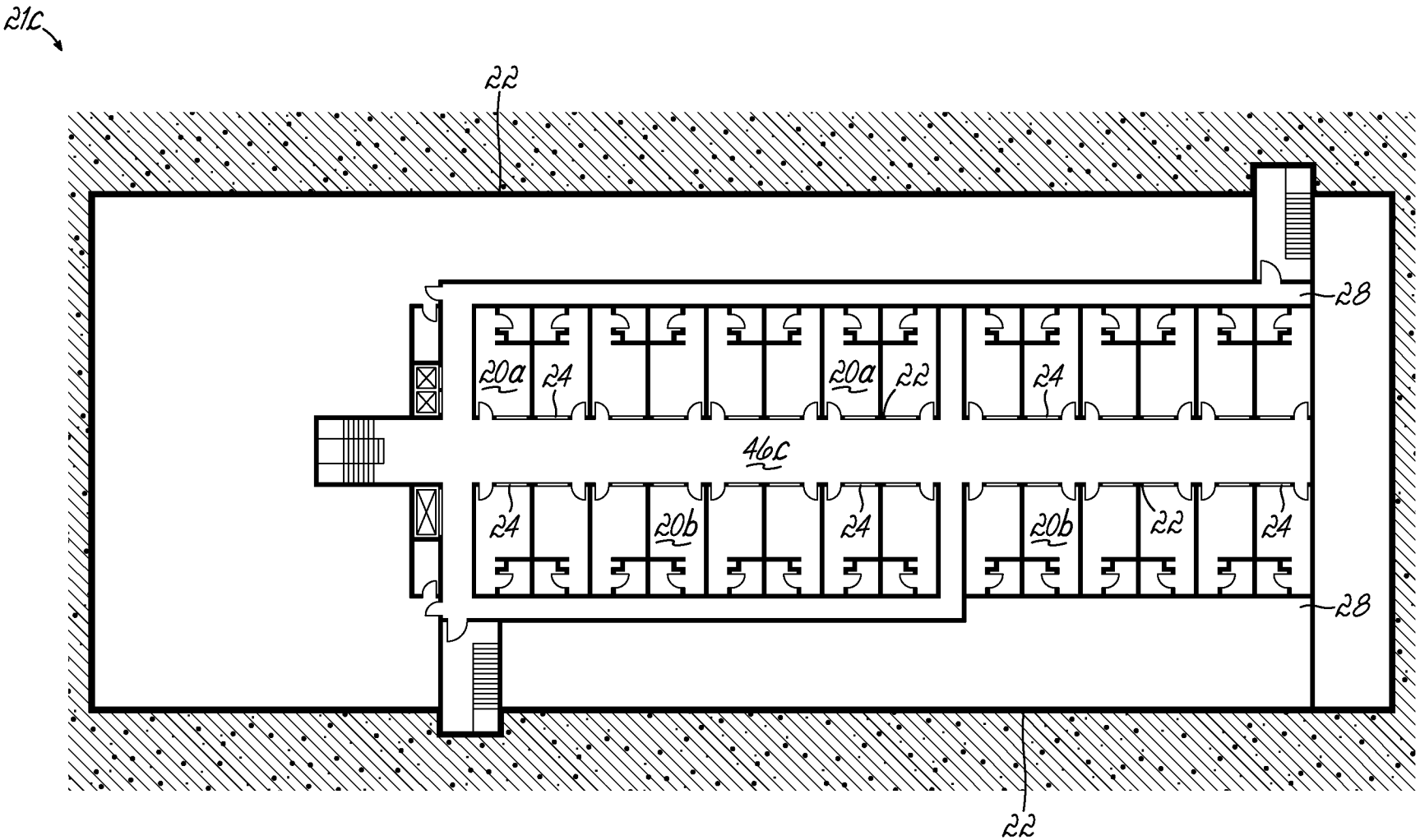
FIG. 3 is a top plan view of an exemplary lowermost subterranean floor level of the subterranean hotel of FIG. 1.
Figure 4:
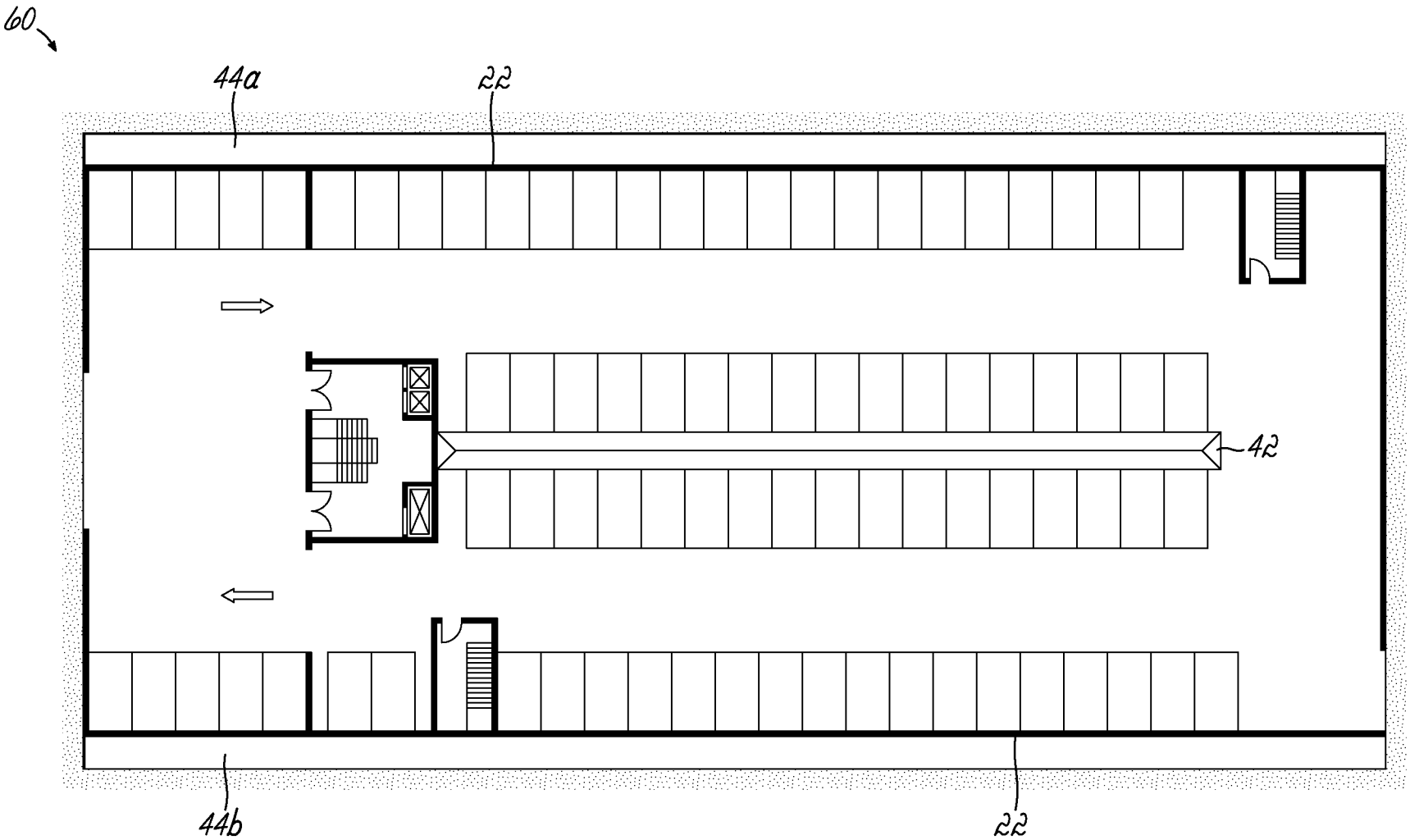
FIG. 4 is a top plan view of an exemplary parking structure of the subterranean hotel of FIG. 1.

For example, as illustrated by FIGS. 1, 2, and 3, the subterranean hotel 10 includes three subterranean floor levels 21*a*, 21*b*, 21*c*. The atrium hotel rooms 20 span all three subterranean floor levels 21*a*, 21*b*, 21*c* while the patio hotel rooms 30 span only subterranean floor levels 21*a*, 21*b*. Accordingly, the intermediate atrium 40 extends, by way of the openings 46*a*, 46*b* of the atrium floors 45*a*, 45*b*, to all three subterranean floor levels 21*a*, 21*b*, 21*c* while the outside window wells 44*a*, 44*b* extend to subterranean floor levels 21*a*, 21*b*.

As best shown in FIGS. 1-4, the intermediate atrium 40 facilitates the transmission of natural light from an atrium window 42 to the plurality of atrium hotel rooms 20. The intermediate atrium 40 may vary in shape across embodiments of the present invention, partially driven by the structural design of the subterranean hotel 10.

For example, FIG. 1A presents an alternative embodiment of the subterranean hotel 10, namely subterranean hotel 10'. Various features of the subterranean hotel 10' are generally similar to those described throughout with respect to the subterranean hotel 10 and are not repeated here for the sake of brevity. However, a difference between the subterranean hotel 10 and the subterranean hotel 10' is that the subterranean hotel 10 has a single level above-ground parking structure 60, while the subterranean hotel 10' has a two level above-ground parking structure 60'. Because of the additional level above-ground, the intermediate atrium 40' of the subterranean hotel 10' requires a more vertically elongated shape than that of the intermediate atrium 40 in order to facilitate the transmission of natural light from the atrium window 42 to the plurality of atrium hotel rooms 20.

Alternative embodiments of the present invention may utilize more than one intermediate atrium 40 (not shown). In these embodiments, the atrium hotel rooms 20 may not all abut with the same intermediate atrium 40, however each of the atrium hotel rooms 20 will abut with at least one intermediate atrium 40 along their sidewall 22. In other words, each of the atrium hotel rooms 20 will receive natural light from at least one intermediate atrium 40.

Figure 2A:
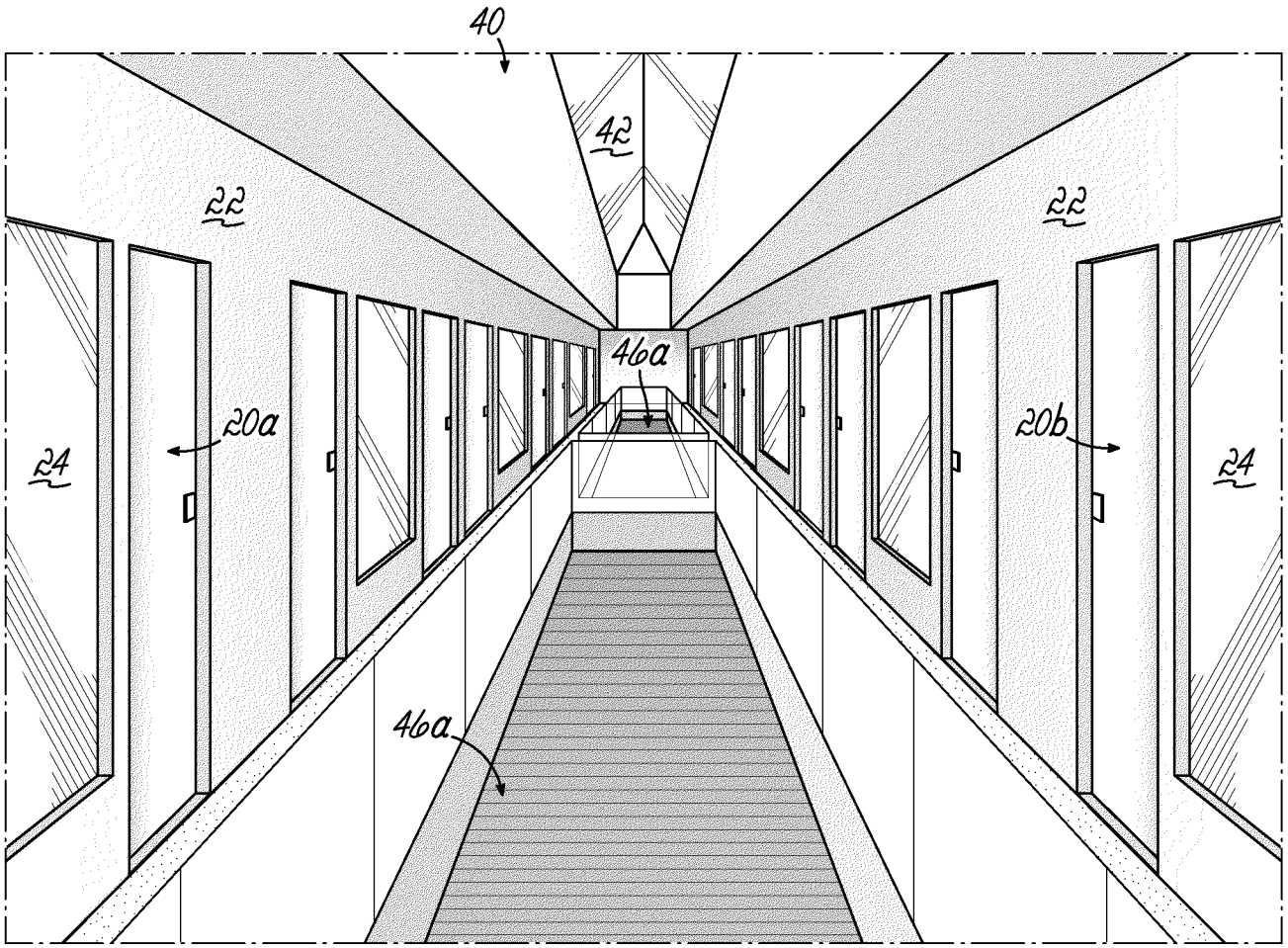
FIG. 2A is a perspective view of the first subterranean floor level of the subterranean hotel of FIG. 1.
Figure 2B:
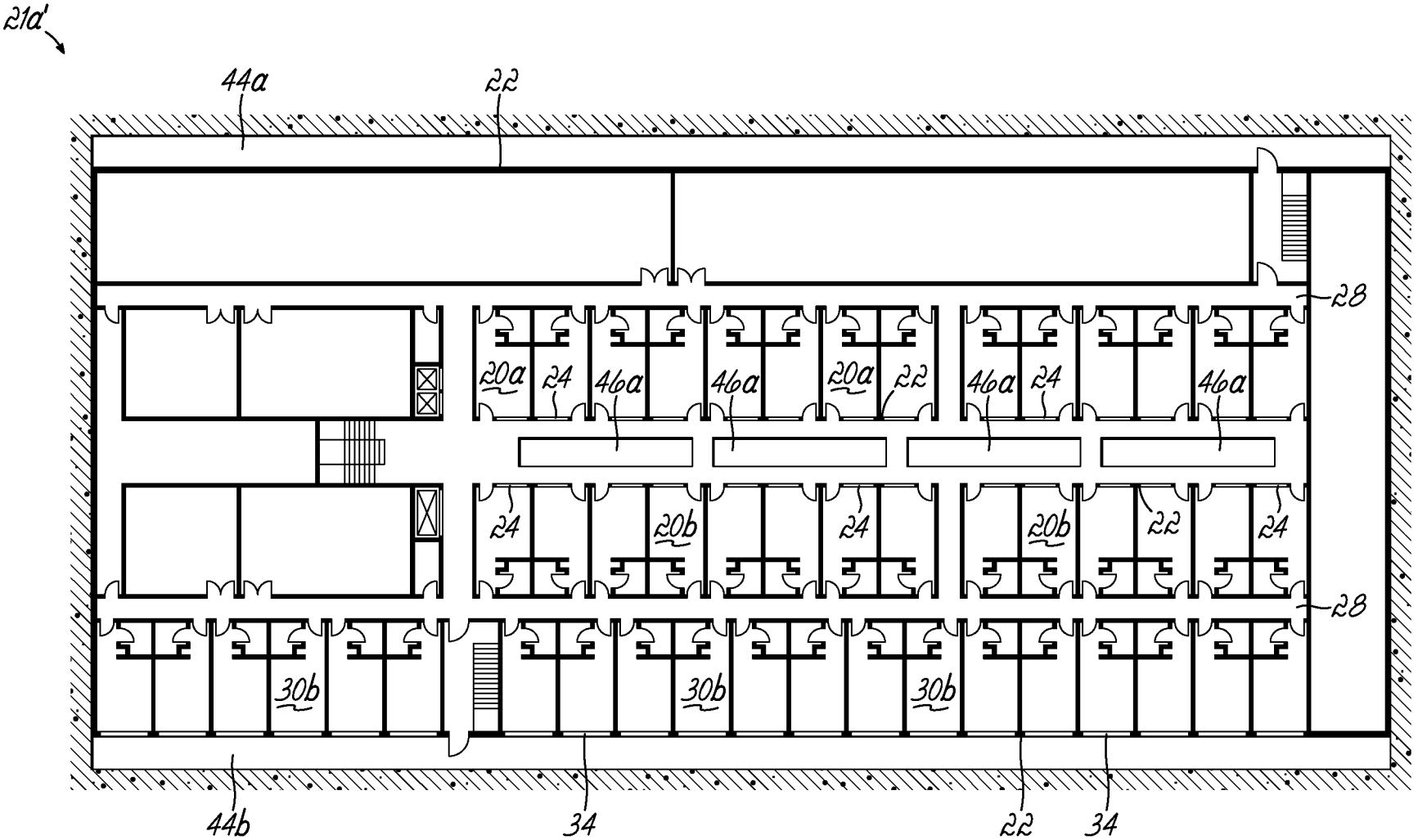
FIG. 2B is a top plan view of an exemplary first subterranean floor level of an alternative subterranean hotel in accordance with another embodiment of the present invention.

In the embodiments presented via the subterranean hotels 10, 10', and as can be seen in FIGS. 1, 1A, and 2A, the atrium window 42 may be a skylight. However, in alternative embodiments, the atrium window 42 may be an open air boundary or any other interface that allows for natural light to traverse the interface and enter the intermediate atrium 40, 40'.

In an embodiment of the present invention, where multiple subterranean floor levels 21 exist, the intermediate atrium 40 may extend through each subterranean floor level 21 using at least one opening 46, as can be seen in FIGS. 1, 2, and 2A. In the current embodiment, and as exemplified by in FIG. 2, four openings 46*a* are used on subterranean floor level 21*a*. Other embodiments may use a single opening 46 or an alternative number of openings 46.

As best shown in FIGS. 1-2, 3, and 4, the outside window wells 44*a*, 44*b* may facilitate the transmission of natural light from perimeter light interfaces 48*a*, 48*b* to the patio hotel rooms 30*a*, 30*b*. The outside window wells 44*a*, 44*b* may be subterranean and, varying in shape and quantity across embodiments of the present invention. For example, the outside window wells 44*a*, 44*b* may be of an elongated shape so that the outside window well 44*a* may be common to each of the patio hotel rooms 30*a*, and the outside window well 44*b* may be common to each of the patio hotel rooms 30*b*. In the exemplary embodiment, two outside window wells are present, although more than two or a single outside window well 44 may be present in alternative embodiments. As an example, a single outside window well 44 that abuts with the entire perimeter of the subterranean hotel 10 may be present. Yet in a further example, a single outside window well 44 may exist on the only side of the subterranean hotel 10 that abuts with the patio hotel rooms 30.

In the one embodiment, the perimeter light interfaces 48*a*, 48*b* may be open air boundaries. However, in alternative embodiments, the perimeter light interfaces 48*a*, 48*b* may be one or more skylights or any other light-transmissive interfaces that allow for natural light to traverse the interface and enter the outside window wells 44*a*, 44*b*. Where multiple subterranean floor levels 21 exist, each of the outside window wells 44*a*, 44*b* may extend downwardly towards the lowest subterranean floor level 21 with at least one of the plurality of patio hotel rooms 30. The outside window wells 44*a*, 44*b* may extend to the same subterranean floor level 21 or different subterranean floor levels 21 so long as the sidewall 22 of each of the plurality of patio hotel rooms 30 abuts at least one of the outside window wells 44*a*, 44*b*.

As can be seen in the exemplary embodiment, the plurality of patio hotel rooms 30 may not all abut with the same outside window well 44, however each of the plurality of patio hotel rooms 30 must abut with at least one outside window well 44 along their sidewall 22. In other words, each of the plurality of patio hotel rooms 30 will receive natural light through at least one outside window well 44.

The foregoing description of specific embodiments will so fully reveal the general nature of embodiments of the invention that others can, by applying knowledge of those of ordinary skill in the art, readily modify and/or adapt for various applications such specific embodiments, without undue experimentation, without departing from the general concept of embodiments of the invention. Therefore, such adaptation and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the specification is to be interpreted by persons of ordinary skill in the relevant art in light of the teachings and guidance presented herein.

While various aspects in accordance with the principles of the invention have been illustrated by the description of various embodiments, and while the embodiments have been described in considerable detail, they are not intended to restrict or in any way limit the scope of the invention to such detail. The various features shown and described herein may be used alone or in any combination. Additional advantages and modifications will readily appear to those skilled in the art. The invention in its broader aspects is therefore not limited to the specific details, representative apparatus and illustrative examples shown and described.

Accordingly, departures may be made from such details without departing from the scope of the general inventive concept.

What is claimed is:

1. A subterranean hotel, comprising:

a first row of subterranean atrium hotel rooms located on a first subterranean floor level;

a second row of subterranean atrium hotel rooms located on the first subterranean floor level and spaced from the first row of atrium hotel rooms by an intermediate atrium having at least one atrium window configured to allow natural light to pass through the at least one atrium window from outside the subterranean hotel to an interior of the intermediate atrium, each of the first and second rows of atrium hotel rooms having a respective floor, an opposite ceiling and a plurality of sidewalls extending between the floor and the ceiling, wherein one of the plurality of sidewalls located adjacent the intermediate atrium of each of the first and second rows of atrium hotel rooms includes at least one atrium window configured to allow natural light to pass through the at least one atrium window from the intermediate atrium to an interior of the atrium hotel room; and a first row of subterranean patio hotel rooms located on the first floor level and spaced from the first row of subterranean atrium hotel rooms in a direction away from the intermediate atrium by a first elongated hallway, each of the first row of patio hotel rooms having a respective floor, an opposite ceiling and a plurality of sidewalls extending between the floor and the ceiling; and at least one first outside window well located externally of at least a portion of a perimeter of the subterranean hotel that interfaces with the first row of subterranean patio hotel rooms, wherein one of the plurality of sidewalls located adjacent the first outside window well of each of the first row of patio hotel rooms includes at least one first patio window configured to allow natural light to pass through the at least one first patio window from the first outside window well to an interior of the patio hotel room.

2. The subterranean hotel of claim 1, further comprising:

a second row of subterranean patio hotel rooms located on the first floor level and spaced from the second row of subterranean atrium hotel rooms in a direction away from the intermediate atrium by a second elongated hallway, each of the second row of patio hotel rooms having a respective floor, an opposite ceiling and a plurality of sidewalls extending between the floor and the ceiling; and at least one second outside window well located externally of at least a portion of a perimeter of the subterranean hotel that interfaces with the second row of subterranean patio hotel rooms, wherein one of the plurality of sidewalls located adjacent the second outside window well includes at least one second patio window configured to allow natural light to pass through the at least one second patio window from the second outside window well to an interior of the patio hotel room.

3. The subterranean hotel of claim 1, further comprising:

a first row of subterranean atrium hotel rooms located on a second floor level located beneath the first floor level;

a second row of subterranean atrium hotel rooms located on the second floor level and spaced from the first row of atrium hotel rooms located on the second floor level by the intermediate atrium, each of the first and second rows of atrium rooms located on the second floor level having a respective floor, an opposite ceiling and a plurality of sidewalls extending between the floor and the ceiling, wherein one of the plurality of sidewalls located adjacent the intermediate atrium includes at least one atrium window configured to allow natural light to pass through the at least one atrium window from the intermediate atrium to an interior of the atrium hotel room; and a first row of subterranean patio hotel rooms located on the second floor level and spaced from the first row of subterranean atrium hotel rooms in a direction away from the intermediate atrium by a first elongated hallway, each of the first row of patio hotel rooms having a respective floor, an opposite ceiling and a plurality of sidewalls extending between the floor and the ceiling, wherein one of the plurality of sidewalls located adjacent a first outside window well includes at least one first patio window configured to allow natural light to pass through the at least one first patio window from the first outside window well to an interior of the patio hotel room.

4. The subterranean hotel of claim 3, further comprising:

a second row of subterranean patio hotel rooms located on the second floor level and spaced from the second row of subterranean atrium hotel rooms in a direction away from the intermediate atrium by a second elongated hallway, each of the second row of patio hotel rooms having a respective floor, an opposite ceiling and a plurality of sidewalls extending between the floor and the ceiling, wherein one of the plurality of sidewalls located adjacent a second outside window well includes at least one second patio window configured to allow natural light to pass through the at least one second patio window from the second outside window well to an interior of the patio hotel room.

5. The subterranean hotel of claim 1, wherein the first outside window well is elongated and common to each of the first row of patio hotel rooms located on the first subterranean floor level.

6. The subterranean hotel of claim 2, wherein the second outside window well is elongated and common to each of the second row of patio hotel rooms located on the first subterranean floor level.

7. The subterranean hotel of claim 3, wherein the first outside window well is elongated and common to each of the first row of patio hotel rooms located on the second subterranean floor level.

8. The subterranean hotel of claim 4, wherein the second outside window well is elongated and common to each of the second row of patio hotel rooms located on the second subterranean floor level.

9. The subterranean hotel of claim 3, further comprising an elongated atrium floor located on the first floor level between the first row of atrium hotel rooms and the second row of atrium hotel rooms.

10. The subterranean hotel of claim 9, wherein the elongated atrium floor includes at least one opening extending therethrough configured to allow natural light to pass through the at least one opening from the atrium to the second floor level.

11. The subterranean hotel of claim 1, further comprising at least one above-ground level.

12. The subterranean hotel of claim 11, wherein the above-ground level comprises a parking structure.

13. The subterranean hotel of claim 1, wherein at least one of the first and second rows of subterranean atrium hotel rooms is longitudinal.

14. The subterranean hotel of claim 1, wherein the first row of subterranean patio hotel rooms is longitudinal.

* * * * *